US008177564B1

(12) United States Patent
Ito et al.

(10) Patent No.: US 8,177,564 B1
(45) Date of Patent: May 15, 2012

(54) RECEPTACLE CONNECTOR AND AN ELECTRICAL CONNECTOR USING THE SAME

(75) Inventors: Toshiyasu Ito, Togane (JP); Donald Eric Thompson, Fremont, CA (US); Takeshi Nishimura, Santa Clara, CA (US)

(73) Assignees: Yamaichi Electronics Co., Ltd., Tokyo (JP); Yamaichi Electronics USA, Inc., San Jose, CA (US)

( * ) Notice: Subject to any disclaimer, the term of this patent is extended or adjusted under 35 U.S.C. 154(b) by 0 days.

(21) Appl. No.: 12/960,044

(22) Filed: Dec. 3, 2010

(51) Int. Cl.
*H01R 13/648* (2006.01)
*H01R 4/66* (2006.01)

(52) U.S. Cl. ..... 439/108

(58) Field of Classification Search ..... 439/65, 439/660, 79, 108
See application file for complete search history.

(56) References Cited

U.S. PATENT DOCUMENTS

| | | | |
|---|---|---|---|
| 3,823,367 | A | 7/1974 | Kaye et al. |
| 3,932,016 | A | 1/1976 | Ammenheuser |
| 4,189,200 | A | 2/1980 | Yeager et al. |
| 4,404,464 | A | 9/1983 | Moreno |
| 4,421,372 | A | 12/1983 | Golden |
| 4,630,874 | A | 12/1986 | Renn et al. |
| 4,722,693 | A | 2/1988 | Rose |
| 4,780,603 | A | 10/1988 | Hamada |
| 4,810,200 | A | 3/1989 | Sakamoto |
| 4,820,175 | A | 4/1989 | Hasegawa et al. |
| 4,864,116 | A | 9/1989 | Banjo et al. |
| 4,952,161 | A | 8/1990 | Komatsu |
| 5,033,972 | A | 7/1991 | Komatsu et al. |
| 5,035,633 | A | 7/1991 | Kobayashi et al. |
| 5,036,430 | A | 7/1991 | Hills |
| 5,051,101 | A | 9/1991 | Komatsu |
| 5,145,389 | A | 9/1992 | Okubo |
| 5,179,504 | A | 1/1993 | Kitahara |
| 5,179,505 | A | 1/1993 | Matsuo |
| 5,197,894 | A | 3/1993 | Koike |

(Continued)

FOREIGN PATENT DOCUMENTS

CN 1549400 A 11/2004

(Continued)

OTHER PUBLICATIONS

Ito, T. et al., "Connector", filed Jan. 13, 2011, U.S. Appl. No. 13/005,881.

(Continued)

*Primary Examiner* — Javaid Nasri
(74) *Attorney, Agent, or Firm* — Finnegan, Henderson, Farabow, Garrett & Dunner, LLP

(57) ABSTRACT

A receptacle connector of the present invention is used as an electrical connector configured to connect two circuit boards. The receptacle connector includes: a housing in which a receiving space is formed, a connection target being inserted in the receiving space; a plurality of contacts being arranged parallel to one another, having a plurality of signal line contacts and a plurality of ground contacts, and being placed with every two adjacent signal line contacts for transmitting signals interposed between two ground contacts; a supporting member made of an electrically-insulating synthetic resin material, and configured to integrally support and fix thereto the plurality of contacts; and a common contact made of a conductive resin material and configured to electrically connect the plurality of ground contacts together among the plurality of contacts. The plurality of contacts integrated together by the supporting member are received in the receiving space.

6 Claims, 9 Drawing Sheets

U.S. PATENT DOCUMENTS

| | | | |
|---|---|---|---|
| 5,198,645 | A | 3/1993 | Martin et al. |
| 5,207,598 | A | 5/1993 | Yamada et al. |
| 5,286,207 | A | 2/1994 | McHugh |
| 5,300,763 | A | 4/1994 | Ito et al. |
| 5,320,552 | A | 6/1994 | Reichardt et al. |
| 5,374,198 | A | 12/1994 | Nagata |
| 5,456,610 | A | 10/1995 | Banakis et al. |
| 5,458,506 | A | 10/1995 | Yamaguchi et al. |
| 5,490,791 | A | 2/1996 | Yamada et al. |
| 5,492,481 | A | 2/1996 | Lewis |
| 5,518,986 | A | 5/1996 | Winston |
| 5,533,906 | A | 7/1996 | Abe |
| 5,563,397 | A | 10/1996 | Fujimoto et al. |
| 5,581,127 | A | 12/1996 | Shinohara |
| 5,597,316 | A | 1/1997 | David et al. |
| 5,640,307 | A | 6/1997 | Bleier et al. |
| 5,648,651 | A | 7/1997 | Inoue |
| 5,655,918 | A | 8/1997 | Soh |
| 5,668,365 | A | 9/1997 | Ito et al. |
| 5,674,080 | A | 10/1997 | Takemura |
| 5,695,351 | A | 12/1997 | Kimura et al. |
| 5,703,346 | A | 12/1997 | Bricaud et al. |
| 5,709,573 | A | 1/1998 | McClure |
| 5,718,609 | A | 2/1998 | Braun et al. |
| 5,740,012 | A | 4/1998 | Choi |
| 5,871,365 | A | 2/1999 | Kajiura |
| 5,872,353 | A | 2/1999 | Reichardt et al. |
| 5,876,218 | A | 3/1999 | Liebenow et al. |
| 5,890,920 | A | 4/1999 | David et al. |
| 5,899,763 | A | 5/1999 | Kajiura |
| 5,923,541 | A | 7/1999 | Yasumi |
| 5,953,815 | A | 9/1999 | Kaminski et al. |
| 5,954,521 | A | 9/1999 | Yang |
| 5,967,810 | A | 10/1999 | Spickler et al. |
| 5,967,811 | A | 10/1999 | Yamamoto et al. |
| 6,039,600 | A | 3/2000 | Etters et al. |
| 6,056,571 | A | 5/2000 | Noro |
| 6,056,573 | A | 5/2000 | Nishioka |
| 6,065,984 | A | 5/2000 | Tung |
| 6,068,500 | A | 5/2000 | Kantner |
| 6,068,516 | A | 5/2000 | Chang |
| 6,083,018 | A | 7/2000 | Hara et al. |
| 6,089,919 | A | 7/2000 | Nishioka |
| 6,095,834 | A | 8/2000 | Lai et al. |
| 6,099,346 | A | 8/2000 | Hashiguchi et al. |
| 6,106,313 | A | 8/2000 | Chen |
| 6,109,940 | A | 8/2000 | Chad et al. |
| 6,120,309 | A | 9/2000 | Hara |
| 6,123,557 | A | 9/2000 | Wang et al. |
| 6,123,558 | A | 9/2000 | Shibata |
| 6,126,472 | A | 10/2000 | Choy |
| 6,126,486 | A | 10/2000 | Chang |
| 6,129,571 | A | 10/2000 | Ikemoto |
| 6,129,572 | A | 10/2000 | Feldman et al. |
| 6,135,809 | A | 10/2000 | Asakawa |
| 6,139,340 | A | 10/2000 | Niitsu |
| 6,152,748 | A | 11/2000 | Sato et al. |
| 6,155,853 | A | 12/2000 | Kajiura |
| 6,159,027 | A | 12/2000 | Kuo |
| 6,162,083 | A | 12/2000 | Seto |
| 6,174,197 | B1 | 1/2001 | Hirata et al. |
| 6,176,737 | B1 | 1/2001 | Choy |
| 6,200,148 | B1 | 3/2001 | Yu |
| 6,203,345 | B1 | 3/2001 | Roque et al. |
| 6,203,378 | B1 | 3/2001 | Shobara et al. |
| 6,210,174 | B1 | 4/2001 | Pei et al. |
| 6,210,187 | B1 | 4/2001 | Tung |
| 6,210,209 | B1 | 4/2001 | Wu et al. |
| 6,213,785 | B1 | 4/2001 | Nishio et al. |
| 6,227,879 | B1 | 5/2001 | Dong |
| 6,231,360 | B1 | 5/2001 | Horie |
| 6,234,813 | B1 | 5/2001 | Hanyu |
| 6,234,845 | B1 | 5/2001 | Hakozaki |
| 6,261,106 | B1 | 7/2001 | Tung |
| 6,270,365 | B1 | 8/2001 | Nishioka |
| 6,273,737 | B1 | 8/2001 | Furusho et al. |
| 6,290,136 | B1 | 9/2001 | Koseki et al. |
| 6,299,465 | B1 | 10/2001 | Hirata |
| 6,302,715 | B1 | 10/2001 | Sato et al. |
| 6,319,029 | B2 | 11/2001 | Nishioka |
| 6,332,790 | B1 | 12/2001 | Ishikawa et al. |
| 6,345,760 | B1 | 2/2002 | Eason et al. |
| 6,361,339 | B1 | 3/2002 | Zhang et al. |
| 6,361,369 | B1 | 3/2002 | Kondo et al. |
| 6,364,674 | B1 | 4/2002 | Kajlura |
| 6,383,017 | B1 | 5/2002 | Takayasu |
| 6,386,920 | B1 | 5/2002 | Sun |
| 6,394,827 | B2 | 5/2002 | Nogami |
| 6,399,906 | B1 | 6/2002 | Sato et al. |
| 6,402,529 | B2 | 6/2002 | Saito et al. |
| 6,419,524 | B1 | 7/2002 | Ma |
| 6,431,897 | B1 | 8/2002 | Hashiguchi et al. |
| 6,457,647 | B1 | 10/2002 | Kurihashi et al. |
| 6,468,101 | B2 | 10/2002 | Suzuki |
| 6,482,027 | B2 | 11/2002 | Ishii et al. |
| 6,482,029 | B2 | 11/2002 | Nishimura |
| 6,482,030 | B1 | 11/2002 | Kuo |
| 6,503,092 | B1 | 1/2003 | Sato |
| 6,506,074 | B2 | 1/2003 | Hashimoto |
| 6,511,350 | B1 | 1/2003 | Ito et al. |
| 6,524,137 | B1 | 2/2003 | Liu et al. |
| 6,527,590 | B2 | 3/2003 | Oguchi |
| 6,540,560 | B1 | 4/2003 | Ito et al. |
| 6,601,766 | B2 | 8/2003 | Nakagawa et al. |
| 6,607,404 | B1 | 8/2003 | Ito et al. |
| 6,607,405 | B2 | 8/2003 | Nishimura |
| 6,612,492 | B1 | 9/2003 | Yen |
| 6,641,413 | B2 | 11/2003 | Kurodu |
| 6,653,559 | B2 | 11/2003 | Chirumbolo |
| 6,666,724 | B1 | 12/2003 | Lwee |
| 6,676,444 | B2 | 1/2004 | Noro |
| 6,699,053 | B2 | 3/2004 | Kuroda |
| 6,699,061 | B2 | 3/2004 | Abe et al. |
| 6,716,066 | B1 | 4/2004 | Kuo |
| 6,729,892 | B2 | 5/2004 | Takada et al. |
| 6,755,682 | B2 | 6/2004 | Kunishi et al. |
| 6,767,233 | B2 | 7/2004 | Tsunematsu |
| 6,780,062 | B2 | 8/2004 | Liu et al. |
| 6,783,399 | B2 | 8/2004 | Joung |
| 6,790,074 | B1 | 9/2004 | Chiu |
| 6,808,412 | B2 | 10/2004 | Ishi |
| 6,851,959 | B2 | 2/2005 | Ooya et al. |
| 6,851,968 | B2 | 2/2005 | Tsunematsu |
| 6,855,009 | B2 | 2/2005 | Nishiyama |
| 6,863,559 | B2 | 3/2005 | Yu |
| 6,863,571 | B2 | 3/2005 | Sato et al. |
| 6,869,307 | B2 | 3/2005 | Endo |
| 6,921,274 | B2 | 7/2005 | Yu |
| 6,971,908 | B2 | 12/2005 | Shiu et al. |
| 6,976,879 | B2 | 12/2005 | Shishikura et al. |
| 7,048,573 | B2 | 5/2006 | Masaki et al. |
| 7,101,188 | B1 | 9/2006 | Summers et al. |
| 7,128,611 | B2 | 10/2006 | Tanaka |
| 7,140,909 | B2 | 11/2006 | Moritake |
| 7,182,645 | B2 | 2/2007 | Shimizu et al. |
| 7,189,105 | B2 | 3/2007 | Takaku et al. |
| 7,273,381 | B2 | 9/2007 | Ito |
| 7,275,955 | B2 | 10/2007 | Ko |
| 7,297,020 | B2 | 11/2007 | Takahira |
| 7,320,623 | B2 | 1/2008 | Hisamatsu et al. |
| 7,438,598 | B1 | 10/2008 | Ito et al. |
| 7,445,493 | B2 | 11/2008 | Takahira |
| 7,458,829 | B2 * | 12/2008 | Shioda et al. ..... 439/108 |
| 7,625,231 | B2 | 12/2009 | Takahira |
| 7,695,311 | B2 | 4/2010 | Nemoto |
| 2002/0119704 | A1 | 8/2002 | Ito et al. |
| 2003/0092310 | A1 | 5/2003 | Kunishi et al. |
| 2003/0157839 | A1 | 8/2003 | Yamaguchi et al. |
| 2004/0026507 | A1 | 2/2004 | Nagata et al. |
| 2004/0106326 | A1 | 6/2004 | Hsieh |
| 2005/0075004 | A1 | 4/2005 | Endou et al. |
| 2006/0172590 | A1 | 8/2006 | Yamada et al. |
| 2006/0189175 | A1 | 8/2006 | Kinsley |
| 2007/0054545 | A1 | 3/2007 | Takahira |
| 2007/0099514 | A1 | 5/2007 | Ito |
| 2008/0220644 | A1 | 9/2008 | Yamada et al. |

FOREIGN PATENT DOCUMENTS

| | | | |
|---|---|---|---|
| DE | 3 937 383 | A1 | 6/1990 |
| DE | 4 139 482 | | 6/1993 |
| EP | 0 284 431 | | 9/1988 |
| EP | 0 696 008 | | 2/1996 |
| EP | 1 487 001 | | 9/1997 |
| EP | 0 933 837 | A1 | 8/1999 |
| EP | 0 936 705 | A2 | 8/1999 |
| EP | 0 939 582 | A2 | 9/1999 |
| EP | 1 146 474 | | 10/2001 |
| EP | 1 324 256 | | 7/2003 |
| JP | 55-140279 | | 11/1980 |
| JP | 56-84281 | | 7/1981 |
| JP | 59-110990 | U | 7/1984 |
| JP | 63-83779 | U | 6/1988 |
| JP | 63-133473 | | 6/1988 |
| JP | 01-168978 | | 7/1989 |
| JP | 02-187887 | | 7/1990 |
| JP | 03-46969 | | 4/1991 |
| JP | 05-21118 | | 1/1993 |
| JP | 05-502746 | | 5/1993 |
| JP | 06-035415 | | 2/1994 |
| JP | 06-044052 | | 2/1994 |
| JP | 06-139415 | | 5/1994 |
| JP | 06-162281 | | 6/1994 |
| JP | 07-057825 | | 3/1995 |
| JP | 07-153524 | | 6/1995 |
| JP | 07-192102 | | 7/1995 |
| JP | 8-148222 | A | 6/1996 |
| JP | 08-236225 | | 9/1996 |
| JP | 08-306446 | | 11/1996 |
| JP | 08-315081 | | 11/1996 |
| JP | 09-007694 | | 1/1997 |
| JP | 09-293571 | | 11/1997 |
| JP | 10-091729 | | 4/1998 |
| JP | 10-187896 | | 7/1998 |
| JP | 10-240871 | | 9/1998 |
| JP | 11-053503 | | 2/1999 |
| JP | 11-121108 | | 4/1999 |
| JP | 11-316110 | | 11/1999 |
| JP | 2000-133351 | | 5/2000 |
| JP | 2000-277200 | | 6/2000 |
| JP | 2000-251024 | | 9/2000 |
| JP | 2000-251025 | | 9/2000 |
| JP | 2000-277207 | | 10/2000 |
| JP | 2001-135385 | | 5/2001 |
| JP | 2001 160458 | | 6/2001 |
| JP | 2001-195546 | | 7/2001 |
| JP | 2001-203039 | | 7/2001 |
| JP | 2001-237027 | | 8/2001 |
| JP | 2002-056935 | | 2/2002 |
| JP | 2002-100425 | | 4/2002 |
| JP | 2002-100426 | | 4/2002 |
| JP | 2002-124321 | | 4/2002 |
| JP | 2002-157027 | | 5/2002 |
| JP | 2002-157056 | | 5/2002 |
| JP | 2002-270261 | A | 9/2002 |
| JP | 3380539 | | 12/2002 |
| JP | 03-425696 | | 5/2003 |
| JP | 2003-272774 | | 9/2003 |
| JP | 2003-317858 | | 11/2003 |
| JP | 2004-039404 | | 2/2004 |
| JP | 2004-193045 | | 7/2004 |
| JP | 2004-319145 | | 11/2004 |
| JP | 2005-004993 | | 1/2005 |
| JP | 2005-129490 | | 5/2005 |
| JP | 2005-174893 | | 6/2005 |
| JP | 2006-085989 | | 3/2006 |
| JP | 2007-042608 | | 2/2007 |
| JP | 2007-123183 | | 5/2007 |
| JP | 2007-149643 | | 6/2007 |
| JP | 2007-213998 | | 8/2007 |
| JP | 2008-098000 | | 4/2008 |
| JP | 2008-186600 | | 8/2008 |
| JP | 2009-187809 | | 8/2009 |
| JP | 2010-19205 | | 1/2010 |

OTHER PUBLICATIONS

Chinese Office Action and English Translation for Chinese Patent Application No. 2004100807089, dated Mar. 10, 2006, 12 pages.

Chinese Office Action in counterpart Chinese Patent Application No. 200610101733.X, dated Nov. 16, 2007, 5 pages.

HF602—A Product Brochure published by the applicant on Jun. 13, 2008, 2 pages.

High-Speed Connection System—A product brochure published by the applicant on Mar. 2007, 8 pages.

Information Offer Form of Japanese Patent Office for corresponding Japanese Patent Application No. 2009-074235 issued on Apr. 15, 2010, 9 pages.

Office Action dated Feb. 15, 2008 in corresponding Chinese Patent Application No. 2006-10151635.7, 10 pages.

Official Action of Japanese Patent Office for Application No. 2003-385753, mailed Jun. 14, 2005, 4 pages.

Official Letter mailed Apr. 1, 2011 in corresponding Japanese Patent Application No. 2005-260695, 2 pages.

Official Letter mailed Sep. 10, 2010 in corresponding Japances Patent Application No. 2005-260695, 2 pages.

Official Notice from Japanese Patent Office for corresponding Japanese Patent Application No. 2002-098965, mailed Jul. 23, 2004, 44 pages.

Official Notice of Rejection of Japanese Patent Office for corresponding Japanese Patent Application No. 2004-239954, dated Oct. 16, 2007, 7 pages.

* cited by examiner

RECEPTACLE CONNECTOR AND AN ELECTRICAL CONNECTOR USING THE SAME

BACKGROUND OF THE INVENTION

1. Field of the Invention

The present invention relates to a receptacle connector serving as a female connector for an electrical connector configured to connect two circuit boards to each other. More specifically, the present invention relates to a receptacle connector having a crosstalk reduction structure, and to an electrical connector using the same.

2. Description of the Related Art

Heretofore, it is well-known to provide a receptacle connector serving as a female connector to a printed wiring board serving as a circuit board, and to electrically connect this printed wiring board to another printed wiring board serving as another circuit board through the receptacle connector. Such an electric connector at least including a receptacle connector has been disclosed in Japanese Patent Laid-Open No. 2007-149643, for example.

In the conventional receptacle connector, the following contact layout has been known in order to suppress crosstalk. Specifically, a coplanar structure is adopted as the contact layout, and ground contacts (G) are disposed such that the ground contacts sandwiches two signal line contacts (S) used for transmitting signals. That is, the contacts are laid out so as to form a G-S-S-G pattern.

However, along with speeding up of signal transmission in recent years, crosstalk between adjacent signal lines is becoming a serious problem. In particular, in high-speed transmission, it is necessary to suppress an amount of crosstalk to a very small level in a much higher frequency domain.

A layout structure generally used in connectors for high-speed transmission of differential signals is that the ground contacts are placed on both sides of two signal line contacts as in the G-S-S-G pattern as described above. Moreover, when a plurality of sets each consisting of two signal line contacts are adjacent to each other, the adjacent sets of two signal line contacts are separated from each other by only one common ground contact as in a G-S-S-G-S-S-G pattern.

In one instance of this the g round wires arranged on the printed wiring board are connected to one another by use of a ground common plane or the like inside the printed wiring board, for example, and are configured to have the same electric potential. However, in the case of a connector in which a plurality of contacts are connected to the printed wiring board through only both end sides of the plurality of contacts, the ground contacts are located at a distance from the ground common plane provided inside the print wiring board. As a result, the ground contacts of the connector have electric potentials different from each other, and have electric potentials also different from an electric potential of the ground wires on the printed wiring board. This degrades shielding effects of the ground contacts against high-frequency signals having frequency components of several gigahertz (GHz). As a consequence, there is a risk of causing a problem of increase in the crosstalk between two immediately-adjacent signal line contacts or between two adjacent signal line contacts located across a ground contact.

To solve this problem, the applicant has already proposed an invention in which a plurality of ground contacts arranged in a receptacle connector are coupled together by use of a common contact made of metal (see Japanese Patent Application No. 2010-019205 filed on Jan. 29, 2010). The present invention aims at a further improvement of this application.

An object of the present invention is to provide: a receptacle connector which achieves reduction in crosstalk between vertically or horizontally adjacent signal line contacts by equalizing electric potentials of ground contacts arranged across every two signal line contacts; and an electrical connector using the receptacle connector.

SUMMARY OF THE INVENTION

For the purpose of attaining the above-mentioned object, a receptacle connector of the present invention is a receptacle connector used for an electrical connector configured to connect two circuit boards to each other. The receptacle connector comprises: a housing made of an electrically-insulating synthetic resin material, the housing including an upper wall, a lower wall, left and right sidewalls, the housing having a receiving space formed therein, the receiving space having an opening portion, through which a connection target is inserted, on a front side thereof; a plurality of contacts made of a metal material and arranged parallel to one another, the plurality of contacts including a plurality of signal line contacts and a plurality of ground contacts, and the plurality of contacts being placed with every two adjacent signal line contacts interposed between two ground contacts; a supporting member made of an electrically-insulating synthetic resin material, and configured to integrally support and fix thereto the plurality of contacts; and a common contact made of a conductive resin material and configured to electrically connect the a plurality of ground contacts together among the a plurality of contacts. The plurality of contacts are received in the receiving space of the housing, the plurality of contacts being integrated together by the supporting member, all the plurality of ground contacts among the plurality of contacts being electrically connected together by the common contact.

In an aspect of the present invention, it is desirable that the plurality of contacts of the receptacle connector of the present invention are formed into two contact assemblies each integrated together by the supporting member, the two contact assemblies are disposed parallel to each other inside the receiving space of the housing and the two circuit boards are electrically connected to each other by inserting the connection target between the two contact assemblies disposed parallel to each other.

In another aspect of the present invention, it is desirable that the two contact assemblies of the receptacle connector of the present invention are integrated together.

In addition, the receptacle connector of the present invention may include the plurality of contacts which are integrally supported by and fixed to the supporting member with insert molding and the common contact which is formed by injecting a conductive resin material into a cavity formed in advance inside the supporting member at the time of insert molding.

Furthermore, an electrical connector of the present invention comprises: the above-mentioned receptacle connector being attached to one of two circuit boards; and a plug connector attached to the other of the two circuit boards and configured to be inserted in the receptacle connector. In addition, the plug connector includes: a blade; a plurality of external contacts arranged corresponding to the plurality of contacts of the receptacle connector; and a common contact configured to electrically connect together a plurality of ground external contacts among the plurality of external contacts, the plurality of ground external contacts corresponding to the plurality of ground contacts of the receptacle connector.

In the present invention, all the plurality of ground contacts arranged with every two signal line contacts for transmitting signals at high speed interposed therebetween are electrically connected to one another by use of the common contact, whereby the electric potentials of all the ground contacts connecting the two circuit boards can be kept equal to one another. Accordingly, the connector of the present invention exerts a better shielding effect than a conventional connector, and can sufficiently reduce crosstalk between signals passing through the signal line contacts which are arranged vertically or horizontally adjacent to each other. Moreover, it is possible to suppress the occurrence of noises attributable to the signals passing through the signal line contacts.

Meanwhile, the plurality of contacts in each of the two rows included in the receptacle connector are integrated with the common contact by the supporting member. For this reason, it is easy to assemble the connector, and it is possible to ensure that: the plurality of ground contacts are coupled together by the common contact; and accordingly, the plurality of ground contacts are electrically connected together by the common contact. Moreover, it is possible to simplify the structure of the receptacle connector, and thereby to reduce manufacturing costs and a length of time needed to manufacturing the receptacle connector.

Further features of the present invention will become apparent from the following description of exemplary embodiments with reference to the attached drawings.

DESCRIPTION OF THE EMBODIMENTS

Figure 1:
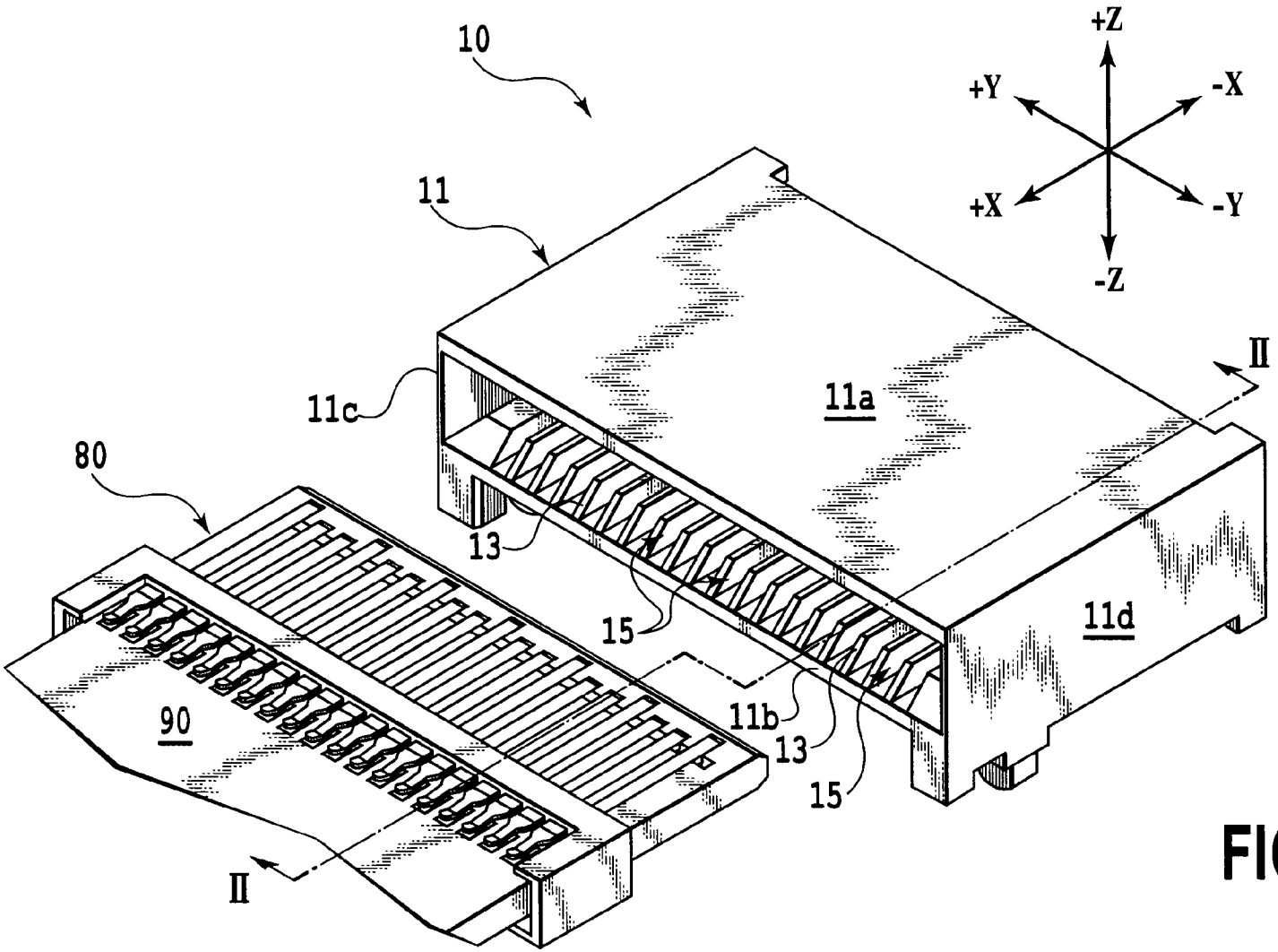
FIG. 1 is a perspective view of an electrical connector including a receptacle connector according to the present invention, which shows the electrical connector in a pre-connected state.

FIG. 1 shows a preferred embodiment of an electrical connector including a receptacle connector according to the present invention. In the following description of the embodiment, it is to be noted that: terms "front" and "back" respectively indicate a +x direction and a −x direction in FIG. 1; terms "left" and "right" respectively indicate a +y direction and a −y direction therein; and terms "upper" and "lower" respectively indicate a +z direction and a −z direction therein.

An electrical connector according to the present invention includes a receptacle connector 10 and a plug connector 80. As shown in FIGS. 1 to 4, the receptacle connector 10 according to the embodiment of the present invention is attached to a first printed wiring board 70 serving as a circuit board. Meanwhile, the plug connector 80 to be inserted into the receptacle connector 10 is attached to a second printed wiring board 90 serving as the other circuit board. The plug connector 80 is inserted into the receptacle connector 10. Incidentally, the second printed wiring board 90 (or an external terminal portion thereof) as the other circuit board may be directly inserted into the receptacle connector 10 with no plug connector 80 interposed in between.

Specifically, a blade 81 of the plug connector 80 is inserted into a first receiving space 16 of the receptacle connector 10. Thereby, a plurality of first pads 82*a* arranged on an upper surface of the blade 81 are brought into contact with contacts 20 of a contact assembly C1 in a first row arranged on an upper side of the receptacle connector 10, while a plurality of second pads 82*b* arranged on a lower surface of the blade 81 are brought into contact with contacts 40 of a contact assembly C2 in a second row arranged on a lower side of the receptacle connector 10, respectively. The plurality of first pads 82*a* and the plurality of second pads 82*b* serve as external contacts, and are made of conductive metal thin plates. The contacts 20 in the first row include a plurality of ground contacts (G) 20*a* and a plurality of signal line contacts (S) 20*b*, which are arranged in the G-S-S-G-S-S-G pattern as described above (see FIG. 5). Like the contacts in the first row, the contacts 40 in the second row include a plurality of ground contacts (G) and a plurality of signal line contacts (S), which are arranged in the G-S-S-G-S-S-G pattern as in the case of the first row. For this reason, it is understood that: the plurality of first pads 82*a* and the plurality of second pads 82*b* on the plug connector 80 include a plurality of signal line external contacts and a plurality of ground external contacts, which are arranged in the G-S-S-G pattern, as well. As a result, the first printed wiring board 70 and the second printed wiring board 90 are electrically connected to each other. Thereby, signals can reciprocate between the first printed wiring board 70 and the second printed wiring board 90 by high speed transmission. Incidentally, this embodiment is based on the assumption that the first pads 82*a* and the second pads 82*b* on the plug connector 80 are staggered when viewed from the back. Accordingly, the contacts 20 in the first row and the contacts 40 in the second row of the receptacle connector 10 are arranged in a way that contact portions 21 of the plurality of contacts 20 and contact portions 41 of the plurality of contacts 40 are staggered when viewed from the front as described later. That is, when viewed from the front, the contact portions 21 and the contact portions 41 are not arranged on the same lines in the vertical direction, but are displaced in a left-right direction.

The receptacle connector 10 according to this embodiment generally comprises a housing 11, the plurality of contacts 20 in the first row, the plurality of contacts 40 in the second row, a first common contact 30, and a second common contact 50. The plurality of contacts 20 in the first row include the plurality of ground contacts 20*a* and the plurality of signal line contacts 20*b*. The plurality of contacts 40 in the second row include the plurality of ground contacts and the plurality of signal line contacts. Moreover, the first common contact 30 electrically connects the plurality of ground contacts 20*a* in the first row to one another, while the second common contact 50 electrically connects the plurality of ground contacts in the second row to one another.

The housing 11 is made of an electrically-insulating synthetic resin such as an LCP (liquid crystal polymer), and a contour thereof is substantially formed in a rectangular solid. In this embodiment, the housing 11 is provided with an upper wall 11*a*, a lower wall 11*b*, a left sidewall 11*c*, and a right sidewall 11*d*. A front portion of the housing 11 is provided with: the first receiving space 16 into which the plug connector 80 is inserted; a plurality of first slits 14 in which the respective a plurality of contacts 20 in the first row are partially received; and a plurality of second slits 15 in which the respective a plurality of contacts 40 are partially received. Meanwhile, a back portion of the housing 11 is provided with a second receiving space 18 in which a first supporting member 35 and a second supporting member 55 are received. The plurality of contacts 20 in the first row are fixed to and supported by the first supporting member 35. The plurality of contacts 40 in the second row are fixed to and supported by the second supporting member 55.

Figure 2:
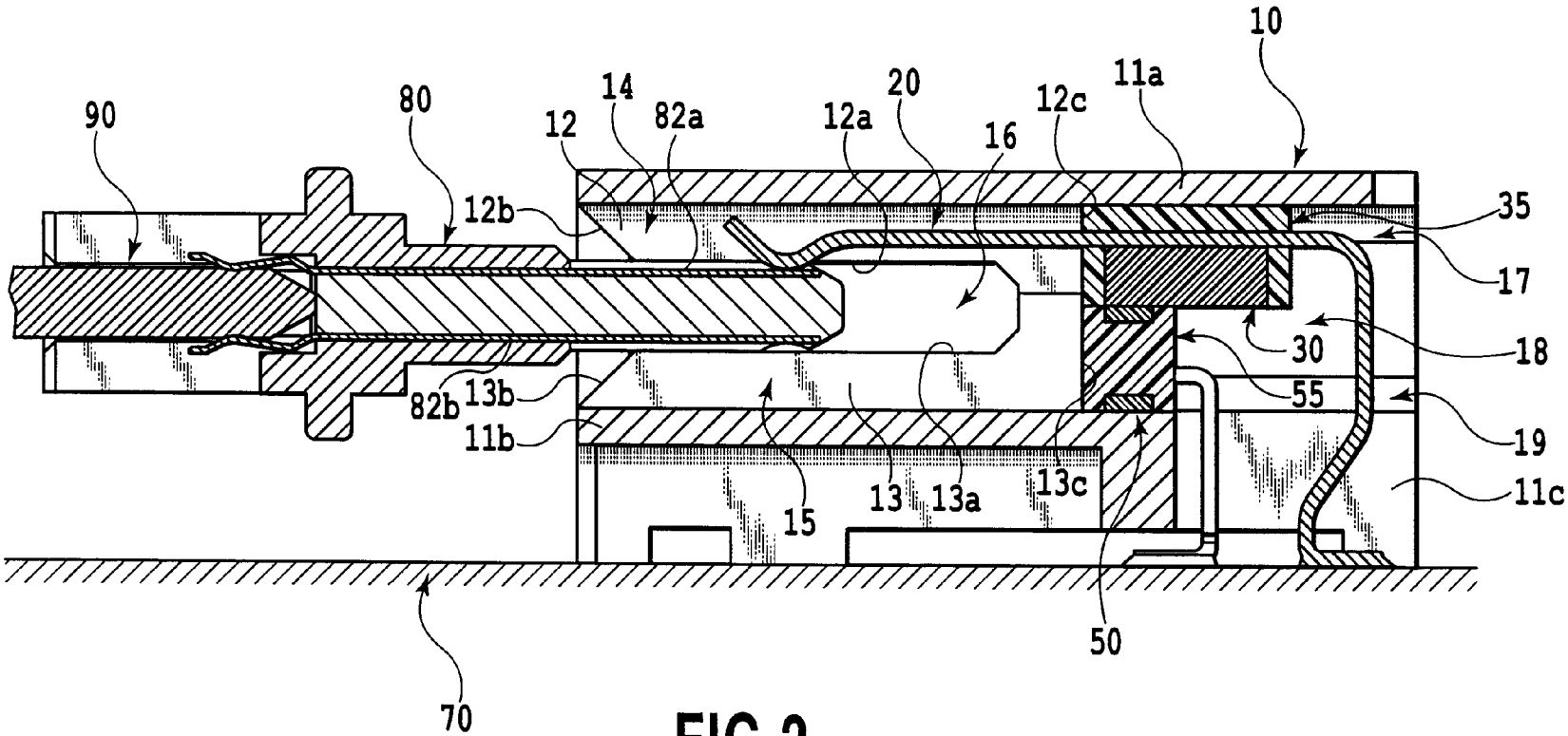
FIG. 2 is a schematic cross-sectional view of the electrical connector shown in FIG. 1 in a connected state, which is taken along the II-II line.

The first receiving space 16 is formed in a way to be opened forward, to extend horizontally in a left-right direction of the receptacle connector 10, and to enable the blade 81 of the plug connector 80 to be inserted thereinto. A vertical sectional shape of the first receiving space 16 is formed in a shape similar to a vertical sectional shape of the plug connector 80, as shown in FIG. 2. Meanwhile, it is desirable that the gap between a front opening portion 12*b* and a front opening portion 13*b* of the first receiving space 16 should have a tapered shape which becomes wider toward the front end in order to guide smooth insertion of the plug connector 80.

To be more specific, the first receiving space 16 is defined by first cutout recessed portions 12*a* provided in a plurality of first partition walls 12 and second cutout recessed portions 13*a* provided in a plurality of second partition walls 13. The first partition walls 12 are formed so as to partition the adjacent first slits 14. Moreover, the first cutout recessed portions 12*a* are formed by partially cutting out the front and lower portions of each of the plurality of first partition walls 12 substantially in a rectangular shape. The front portion of each first cutout recessed portion 12*a* is formed as an inclined surface which is inclined upward. In the meantime, the second partition walls 13 are formed so as to partition the adjacent second slits 15. Moreover, the second cutout recessed portions 13*a* are formed by partially cutting out the front and upper portions of each of the plurality of second partition walls 13 substantially in a rectangular shape while opposed to the first cutout recessed portions 12*a*. The front portion of each second cutout recessed portion 13*a* is formed as an inclined surface which is inclined downward. The front opening portions 13*b* of the second cutout recessed portions 13*a* and the front opening portions 12*b* of the first cutout recessed portions 12*a* collectively define a front opening portion of the first receiving space 16.

Each of the plurality of first slits 14 provided in the front portion of the housing 11 extends in an anteroposterior direction. Each of the plurality of first slits 14 is opened toward: its front; the first receiving space 16 defined by the first cutout recessed portions 12*a* and the second cutout recessed portions 13*a*; and the second receiving space 18. Thus, the plurality of first slits 14 are configured in a way that the first slits 14 are located on the upper portion of the first receiving space 16 and the first slits 14 penetrate the housing 11 via the second receiving space 18. The plurality of first slits 14 are formed parallel to one another, at equal intervals, and at a right angle to the horizontal first receiving space 16. Moreover, the adjacent first slits 14 are partitioned by the first partition walls 12. The first partition walls 12 are formed in a way to extend downward from a lower surface of the upper wall 11*a* at a right angle to the upper wall 11*a*.

Similarly, each of the plurality of second slits 15 provided in the front portion of the housing 11 extends in the anteroposterior direction, and is opened toward: its front; the first receiving space 16 defined by the first cutout recessed portions 12*a* and the second cutout recessed portions 13*a*; and the second receiving space 18. Thus, the plurality of second slits 15 are configured in a way that the second slits 15 are located in the lower portion of the first receiving space 16 and the second slits 15 penetrate the housing 11 via the second receiving space 18. The plurality of second slits 15 are formed in parallel with one another, at equal intervals, and at a right angle to the horizontal first receiving space 16. Furthermore, the adjacent second slits 15 are partitioned by the second partition walls 13. The second partition walls 13 are formed in a way to extend upward from an upper surface of the lower wall 11*b* at a right angle to the lower wall 11*b*.

In this embodiment, as learned from the cross-sectional view in FIG. 2, the upper-disposed first slits 14 and the lower-disposed second slits 15, which are opposed to one another, are displaced in the left-right direction when viewed from the front. Specifically, the first slits 14 and the second slits 15 are staggered when viewed from the front. Furthermore, the first partition walls 12 for partitioning the first slits 14 and the second partition walls 13 for partitioning the second slits 15 are staggered when viewed from the front.

In this embodiment, back end surfaces 12*c* of the respective first partition walls 12 are formed in a way to abut on a front surface of the first supporting member 35 that supports the plurality of contacts 20 in the first row, and define the second receiving space 18. Back end surfaces 13*c* of the respective second partition walls 13 are formed in a way to abut on a front surface of the second supporting member 55 that supports the a plurality of contacts 40 in the second row. The back end surfaces 13*c* define the second receiving space 18 together with the back end surfaces 12*c*. It is desirable that, as shown in FIG. 2, the back end surfaces 12*c* of the first partition walls 12 and the back end surfaces 13*c* of the second partition walls 13*c* should be formed on the same vertical planes, respectively. Moreover, it is desirable that a clearance between the upper surface of each lower wall 11*b* and the lower surface of the corresponding upper wall 11*a* should be set at a value which is equal to or slightly greater than a sum of the heights of the first supporting member 35 and the second supporting member 55.

Next, as shown in FIG. 2, the second receiving space 18 provided in the back portion of the housing 11 is shaped substantially like the letter L in a way that a vertical section of the second receiving space 18 taken along the anteroposterior direction is similar to cross-sectional shapes of the contacts 20, 40 in the first and second rows. The second receiving space 18 is opened backward and partially downward, and the front portion of the second receiving space 18 also communicates with the first and second slits 14, 15. Moreover, the second receiving space 18 is formed in way that: the second receiving space 18 extends horizontally in the left-right direction of the receptacle connector 10; and when assembling the receptacle connector 10, the plurality of contacts 20 in the first row and the plurality of contacts 40 in the second row can be inserted into the second receiving space 18 from the back. In this embodiment, the second receiving space 18 is defined by part of the lower surface of the upper wall 11*a*, part of the upper surface of the lower wall 11*b*, parts of inner surfaces of the left and right sidewalls 11*c*, 11*d*, the back end surfaces 12*c* of the first partition walls 12, and the back end surfaces 13*c* of the second partition walls 13 of the housing 11.

First engagement grooves 17 configured to guide the first supporting member 35, which the contacts 20 in the first row are fixed to and supported by, are formed in the inner surfaces of the left and right sidewalls 11*c*, 11*d* defining the second receiving space 18 in a way that the first engagement grooves 17 extend horizontally in the anteroposterior direction. Meanwhile, it is desirable that the first engagement grooves 17 should be formed along the lower surface of the upper wall 11*a* of the housing 11. Further, second engagement grooves 19 configured to guide the second supporting member 55, which the contacts 40 in the second row are fixed to and supported by, are formed below the first engagement grooves 17 in the inner surfaces of the left and right sidewalls 11*c*, 11*d* in a way that the second engagement grooves 19 are parallel to the first engagement grooves 17. In addition, it is desirable that the second engagement grooves 19 should be formed along the upper surface of the lower wall 11*b*.

Figure 5:
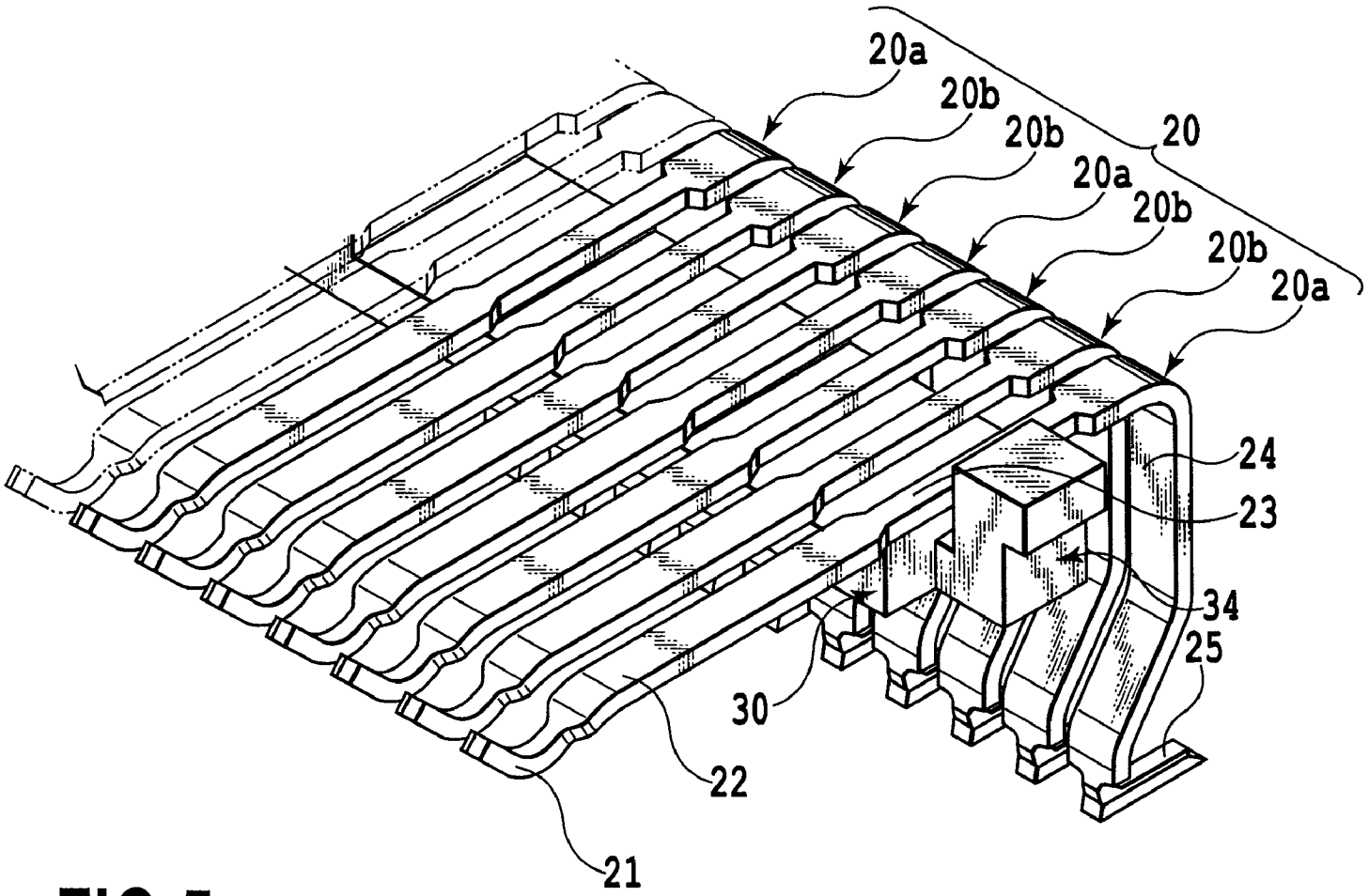
FIG. 5 is a partially enlarged perspective view showing layout relationships among a plurality of contacts in a first row and a common contact in the receptacle connector included in the electrical connector illustrated in FIG. 1.

As described previously, the plurality of contacts 20 in the first row in this embodiment include the plurality of signal line contacts 20*b* and the plurality of ground contacts 20*a* which are arranged in the G-S-S-G pattern (see FIG. 5). Each of the plurality of contacts in the first row in this embodiment is formed in the same shape by: punching a substantially elongated plate shape member out of a metal thin plate; and then bending the member into a form of the letter L.

Figure 3:
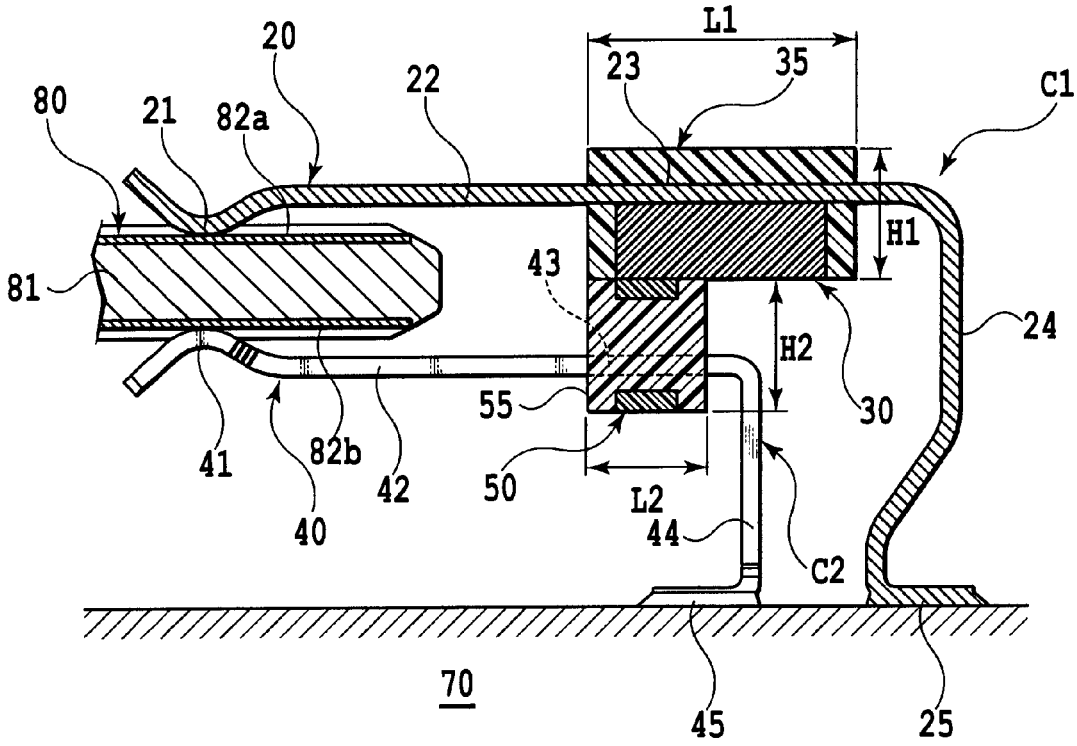
FIG. 3 is a schematic cross-sectional view showing the electrical connector with a housing removed therefrom on the basis of the cross-sectional view of the electrical connector shown in FIG. 2.

As shown in FIG. 3, each of the plurality of contacts in the first row includes a contact portion 21, an elastically-deformable portion 22, a fixed portion 23, a vertical portion 24, and a terminal portion 25. In this embodiment, the contact portions 21 and the elastically-deformable portions 22 are respectively disposed in the first slits 14 provided in the housing 11, as shown in FIG. 2, when the plurality of contacts 20 in the first row are installed in the housing 11. Meanwhile, the vertical portions 24 and the terminal portions 25 are respectively located inside the second receiving space 18 and behind vertical portions 44 and terminal portions 45 of the plurality of contacts 40 in the second row, when the contacts 20 therein are installed in the housing 11.

Figure 4:
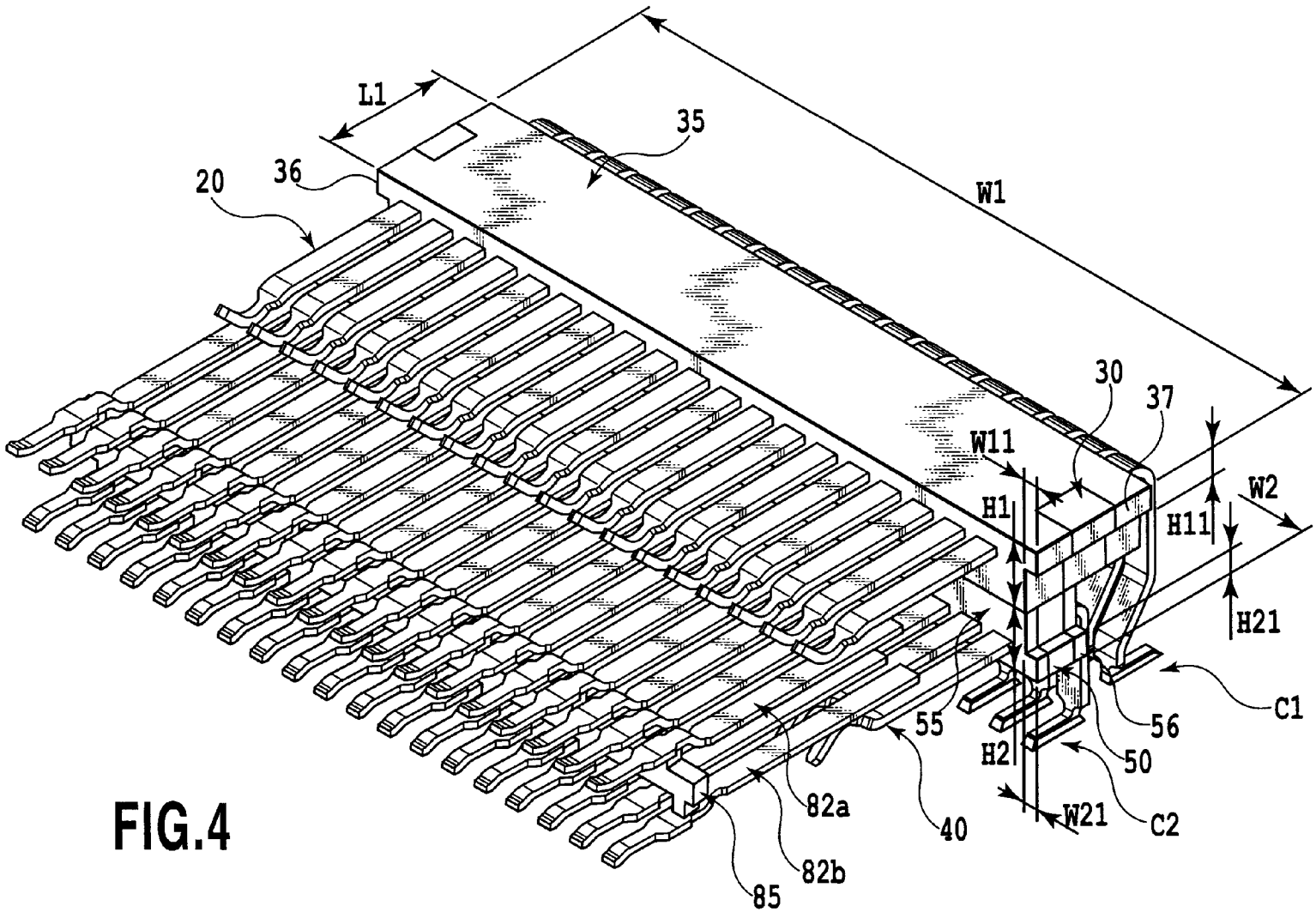
FIG. 4 is a perspective view showing an outline of connection between a plug connector and contacts of the receptacle connector in the electrical connector illustrated in FIG. 2.

In this embodiment, the contact portion 21 of each contact 20 in the first row is shaped like a downward convex curve, and is formed in a way to protrude downward from the first slit 14 into the first receiving space 16, as well as is capable of contacting the corresponding first pad 82*a* serving as one of the external contacts of the plug connector 80 at a desired contact pressure (see FIG. 4).

In this embodiment, the elastically-deformable portion 22 is formed in a way to extend substantially horizontally forward from the fixed portion 23, and to continue to the contact portion 21. When elastically deformed, the elastically-deformed portion 22 gives a desired contact pressure to the contact portion 21.

In this embodiment, the fixed portion 23 is formed in a way to extend continuously from the elastically-deformable portion 22 in the horizontal direction, and to have a width (a length in the left-right direction) smaller than a width of the elastically-deformable portion 22 and a width of the vertical portion 24 that continues from the fixed portion 23 (see FIG. 5). As will be described later, the plurality of contacts 20 in the first row are integrated together by molding the first supporting member 35, which is made of an electrically-insulating synthetic resin, with the fixed portions 23 inserted in the first supporting member 35 (see FIG. 4), and are thereby formed as the contact assembly C1 in the first row. The fixed portions 23 of the plurality of contacts 20 in the first row are integrated together while surrounded by the electrically-insulating synthetic resin having a specific permittivity which is greater than that of air. Accordingly, impedance of the fixed portions 23 is lower than otherwise. For this reason, in this embodiment, impedance matching can be achieved by forming the fixed portions 23 narrower than the other portions in order to suppress reduction in the impedance. Incidentally, among the plurality of contacts 20 in the first row, the plurality of contacts 20*a* used as the ground contacts are electrically connected to the first common contact 30 made of a conductive resin material via the respective fixed portions 23, as will be described later (see FIG. 6).

It is to be noted that a reason why a conventionally-known press-fit mechanism is not adopted for the purpose of fixation of the plurality of contacts 20 in this embodiment is that, if protrusions are provided for the press-fitting, the impedance is reduced and the impedance matching cannot be achieved.

The vertical portion 24 is the portion configured to connect the fixed portion 23 to the terminal portion 25. The vertical portion 24 is bent substantially perpendicularly from the horizontal fixed portion 23, and extends downward in the substantially perpendicular direction, continuing to the terminal portion 25.

The terminal portion 25 is formed below the vertical portion 24. The terminal portion 25 is bent substantially perpendicularly from the vertical portion 24, and is formed in a way to extend backward, as well as is capable of being connected to an external contact (not shown) of the printed wiring board 70. To be concretely, the terminal portion 25 is soldered to the external contact of the printed wiring board 70, and is thereby electrically connected to an electric circuit on the printed circuit board 70.

Next, as described previously, the plurality of contacts 40 in the second row in this embodiment include the plurality of signal line contacts and the plurality of ground contacts which are arranged in the G-S-S-G pattern. In addition, like each of the plurality of contacts 20 in the first row, each of the plurality of contacts in the second row in this embodiment is formed in the same shape by: punching a substantially elongated plate-shape member out of a conductive metal thin plate; and then bending the member into a form of the letter L.

As shown in FIG. 3, like each of the contacts 20 in the first row, each of the plurality of contacts 40 in the second row includes a contact portion 41, an elastically-deformable portion 42, a fixed portion 43, a vertical portion 44, and a terminal portion 45. In this embodiment, the contact portions 41 and the elastically-deformable portions 42 are respectively disposed in the second slits 15 provided in the housing 11, as shown in FIG. 2, when the plurality of contacts 40 in the second row are installed in the housing 11. Meanwhile, the vertical portions 44 and the terminal portions 45 are respectively located inside the second receiving space 18 and in front of the vertical portions 24 and the terminal portions 25 of the plurality of contacts 20 in the first row, when the contacts 40 are installed in the housing 11.

In this embodiment, the contact portion 41 of each contact 40 in the second row is shaped like an upward convex curve, and is formed in a way to protrude upward from the second slit 15 into the first receiving space 16, as well as is capable of contacting the corresponding second pad 82*b* serving as one of the external contacts of the plug connector 80 at a desired contact pressure (see FIG. 4).

In this embodiment, the elastically-deformable portion 42 is formed in a way to extend substantially horizontally forward from the fixed portion 43, and to continue to the contact portion 41. When elastically deformed, the elastically-deformed portion 42 gives a desired contact pressure to the contact portion 41 (see FIG. 3).

In this embodiment, the fixed portion 43 extends continuously in the horizontal direction from the elastically-deformable portion 42. As in the case of each contact 20 in the first row, the fixed portion 43 included in each contact 40 in the second row is formed in a way to have a width (a length in the left-right direction) smaller than a width of the elastically-deformable portion 42 and a width of the vertical portion 44 that continues from the fixed portion 43. In addition, as will be described later, the plurality of contacts 40 in the second row are integrated together by molding an electrically-insulating synthetic resin into the second supporting member 55 with the fixed portions 43 inserted in the second supporting member 55, and are thereby formed into the contact assembly C2 in the second row. With regard to the fixed portions 43 of the plurality of contacts 40 in the second row, too, impedance matching is achieved by forming the fixed portions 43 narrower than the other portions for the same reason as the fixed portions 23 are formed narrower than the other portions in the above-described contacts 20 in the first row. Furthermore, among the plurality of contacts 40 in the second row, the plurality of contacts used as the ground contacts are electrically connected to the second common contact 50 made of a conductive synthetic resin via the respective fixed portions 43, as will be described later.

The vertical portion 44 is the portion configured to connect the fixed portion 43 to the terminal portion 45. The vertical portion 44 is bent substantially perpendicularly from the horizontal fixed portion 43, and extends downward in the substantially perpendicular direction, continuing to the terminal portion 45.

The terminal portion 45 is formed below the vertical portion 44. The terminal portion 45 is bent substantially perpendicularly from the vertical portion 44, and is formed in a way to extend forward, as well as is capable of being connected to an external contact (not shown) of the printed wiring board 70. To be concretely, the terminal portion 45 is soldered to the external contact of the printed wiring board 70, and is thereby electrically connected to an electric circuit on the printed circuit board 70.

Here, descriptions will be provided for the first supporting member for connecting together the plurality of contacts 20 in the first row and the second supporting member for connecting together the plurality of contacts 40 in the second row according to this embodiment with reference to FIGS. 2 to 4.

As described previously, the first supporting member 35 is a member to connect together the plurality of contacts 20 in the first row which are arranged parallel to one another, and is made of the electrically-insulating synthetic resin material such as an LCP (liquid crystal polymer). In this embodiment, the first supporting member 35 and the plurality of contacts 20 in the first row are integrally formed by the insert molding. Thereby, the plurality of contacts 20 in the first row are integrally supported by and fixed to the first supporting member 35 in a way to be arranged parallel to one another and in a straight line in the left-to-right direction. Incidentally, at this stage, a cavity for the first common contact 30, which will be described later, is formed inside the first supporting member 35. The first supporting member 35 is shaped like an elongated rectangular solid extending substantially in the left-to-right direction, and is formed in a way to surround the fixed portions 23 of each of the plurality of contacts 20 in the first row. First engagement protrusions 36, 37 are provided in upper portions of both left and right end portions of the first supporting member 35, respectively, in a way that the first engagement protrusions 36, 37 make a pair (see FIG. 4). The paired first engagement protrusions 36, 37 are respectively fitted in the paired first engagement grooves 17 provided in the inner surfaces of the left and right sidewalls 11*c*, 11*d* of the housing 11, and are useful as a guide when the first supporting member 35 is installed into the second receiving space 18 of the housing 11. Moreover, because the first engagement grooves 17 receive an upward force which is produced by elastic deformation of the contacts 20 in the first row when the contacts 20 come into contact with the first pads 82*a* on the blade 81, the contacts 20 in the first row can obtain a stable contact force. Here, a depth (a length in the anteroposterior direction) of the first supporting member 35 is denoted by reference sign L1; a width (a length in the left-to-right direction) thereof is denoted by reference sign W1; and a height (a length in the vertical direction) thereof is denoted by reference sign H1. Moreover, a height and a protruding length (a protruding length in the left-right direction) of each of the first engagement protrusions 36, 37 are denoted by reference signs H11, W11, respectively.

As described previously, the second supporting member 55 is a member to connect together the plurality of contacts 40 in the second row which are arranged parallel to one another, and is made of the electrically-insulating synthetic resin material such as an LCP (liquid crystal polymer). In this embodiment, the second supporting member 55 and the plurality of contacts 40 in the second row are integrally formed by the insert molding. Thereby, the plurality of contacts 40 in the second row are integrally supported by and fixed to the second supporting member 55 in a way to be arranged parallel to one another and in a straight line in the left-to-right direction. Incidentally, at this stage, a cavity for the second common contact 50, which will be described later, is formed inside the second supporting member 55. The second supporting member 55 is shaped like an elongated rectangular solid extending substantially in the left-to-right direction, and is formed in a way to surround the fixed portions 43 of each of the plurality of contacts 40 in the second row. Second engagement protrusions (although only the protrusion 56 on the right side is shown in FIG. 4) are provided in lower portions of both left and right end portions of the second supporting member 55, respectively, in a way that the second engagement protrusions make a pair. The paired second engagement protrusions 56 are respectively fitted in the paired second engagement grooves 19 provided in the inner surfaces of the left and right sidewalls 11*c*, 11*d* of the housing 11, and are useful as a guide when the second supporting member 55 is installed into the second receiving space 18 of the housing 11. Moreover, because the second engagement grooves 19 receive a downward force which is produced by elastic deformation of the contacts 40 in the second row when the contacts 40 come into contact with the second pads 82*b* on the blade 81, the contacts 40 in the second row can obtain a stable contact force. Here, a depth (a length in the anteroposterior direction) of the second supporting member 55 is denoted by reference sign L2; a width (a length in the left-right direction) thereof is denoted by reference sign W2; and a height (a length in the vertical direction) thereof is denoted by reference sign H2. Moreover, a height and a protruding length (a protruding length in the right-left direction) of each of the second engagement protrusions 56 are denoted by reference signs H21, W21, respectively.

In this embodiment, dimensional relationships between the first supporting member 35 and the second supporting member 55 are as follows. Specifically, the length L1 of the first supporting member 35 is greater than the length L2 of the second supporting member 55 (L1>L2), while the widths and the protruding lengths of these members are equal (W1=W2, W11=W21). Meanwhile, the heights (H1 and H2) of the first and second supporting members 35, 55 and the heights of the first engagement protrusions 36, 37 as well as the heights (H11 and H21) of the second engagement protrusions 56 thereof are equal to one another (H1=H2, H11=H21).

Figure 6:
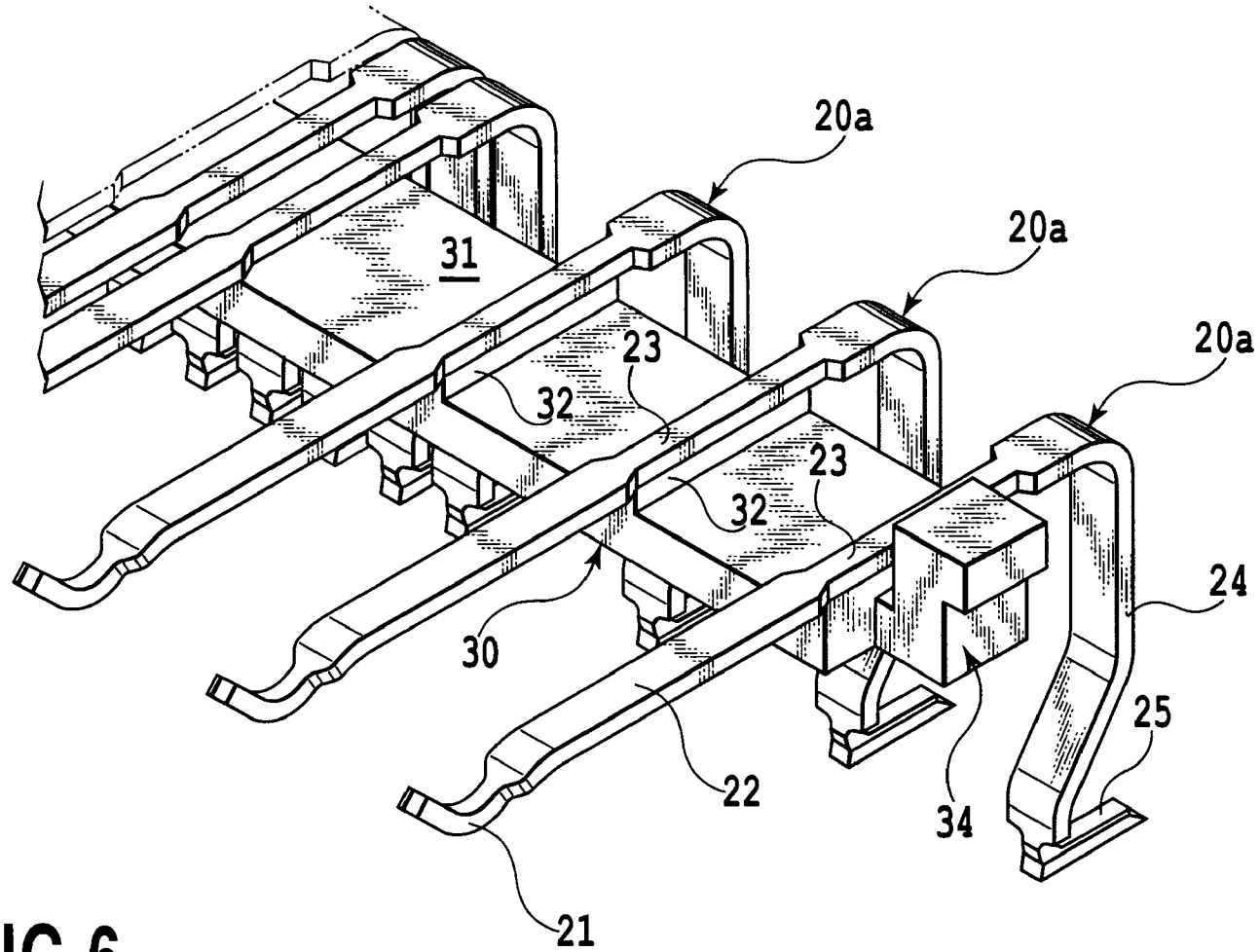
FIG. 6 is a partially enlarged perspective view showing connection relationships among a plurality of ground contacts, which are obtained by removing signal line contacts from the contacts in the first row, and the common contact in the receptacle connector illustrated in FIG. 5.

Next, the common contacts constituting the receptacle connector 10 according to this embodiment, which represent the characteristic feature of the present invention, will be described with reference to FIGS. 6 to 8. In this embodiment, the first common contact 30 is provided in order to equalize the electric potentials of each of the plurality of ground contacts 20*a* among the plurality of contacts 20 in the first row. Similarly, the second common contact 50 is provided in order to equalize the electric potentials of each of the plurality of ground contacts among the plurality of contacts 40 in the second row.

To begin with, descriptions will be provided for the first common contact 30. The first common contact 30 is a member configured to electrically connect together the plurality of ground contacts 20*a*, which are located in every third place, among the plurality of contacts 20 in the first row, in block in order to equalize the electric potentials of the respective ground contacts 20*a*. The first common contact 30 is formed by molding with the conductive resin injected into the cavity provided inside the first supporting member 35 after the plurality of contacts 20 in the first row are integrated together by the first supporting member 35.

To be specific, the first common contact 30 is made of a conductive resin material, which is prepared by mixing micro particulates or fibers of a conductive material such as carbon or nickel into a synthetic resin material such as an LCP (liquid crystal polymer) or PPS (polyphenylene sulfide). The first common contact 30 is integrally formed inside the first supporting member 35 by pouring this conductive resin material into the cavity formed in advance in the first supporting member 35, which is configured to integrally support the plurality of contacts 20 in the first row. As shown in FIGS. 5 and 6, the first common contact 30 is molded in a way to be in contact with the fixed portions 23 of the ground contacts 20*a*, which are arranged in every third place, among the plurality of contacts 20 in the first row.

Figure 7:
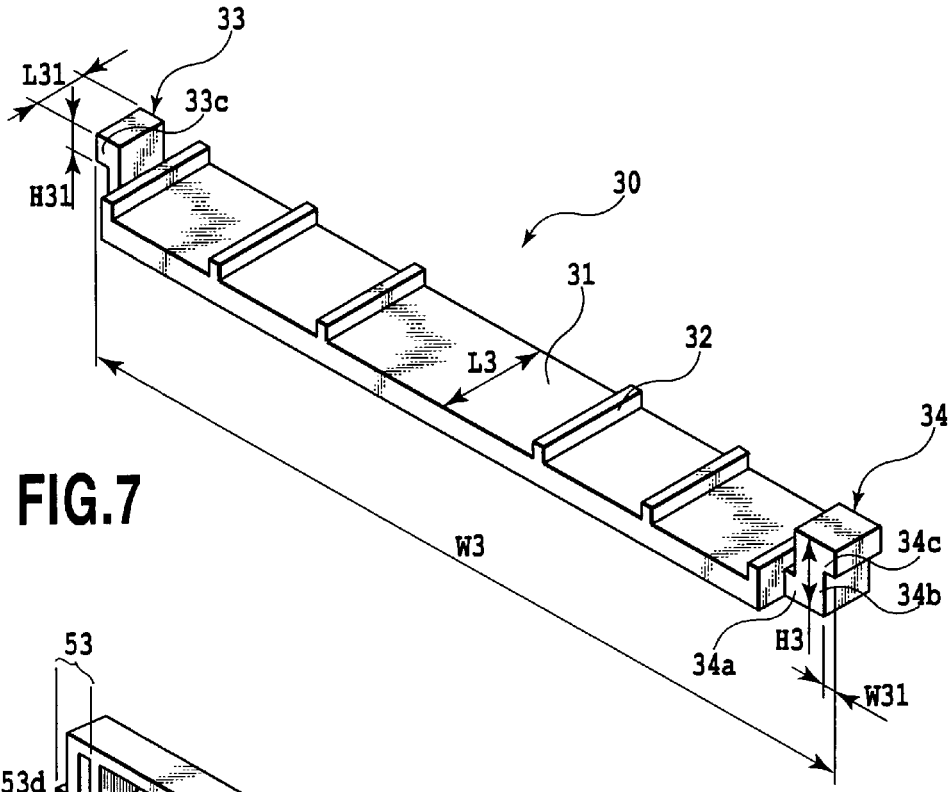
FIG. 7 is a perspective view of a first common contact which is one of the common contacts included in the receptacle connector shown in FIG. 1, and which is configured to connect together the plurality of ground contacts in the first row.

As shown in FIG. 7, the first common contact 30 includes a flat and elongated connecting body 31, contact protrusions 32, and a pair of extended engagement portions 33, 34. The elongated connecting body 31 extends in the left-right direction, and includes the plurality of contact protrusions 32 configured to contact the corresponding ground contacts 20*a*. The plurality of contact protrusions 32 are configured to protrude upward from the connecting body 31 and to extend in the anteroposterior direction, and are disposed parallel to one another. The paired extended engagement portions 33, 34 are provided on both ends of the connecting body 31, respectively.

Since the extended engagement portions 33, 34 make a pair, only the extended engagement portion 34 formed on a right end side of the connecting body 31 will be explained herein while omitting description of the extended engagement portion 33 on a left end side. In this embodiment, the extended engagement portion 34 formed on the right end side of the connecting body 31 includes a horizontal lower step portion 34*a*, a vertical portion 34*b*, and a horizontal upper step portion 34*c*, and therefore is shaped substantially like a staircase when viewed from the front. To be more specific, the horizontal lower step portion 34*a* protrudes horizontally rightward from a right end surface of the connecting body 31. Subsequently, the vertical portion 34*b* extends upward from a right end portion of the horizontal lower step portion 34*a* at a right angle to the horizontal lower step portion 34*a*. Further, the horizontal upper step portion 34*c* extends horizontally rightward from an upper end of the vertical portion 34*b* at a right angle to the vertical portion 34*b*. All of the horizontal lower step portion 34*a*, the vertical portion 34*b*, and the horizontal upper step portion 34*c* have the same depth (the length in the anteroposterior direction). As shown in FIG. 4, the horizontal upper step portion 34*c*, together with the first engagement protrusion 37 of the first supporting member 35, is fitted in the first engagement groove 17 provided in the inner surface of the right sidewall 11*d* of the housing 11, and is useful as a guide when the first supporting member 35 is installed into the second receiving space 18 of the housing 11.

Here, as shown in FIG. 7, a depth (a length in the anteroposterior direction) of the first common contact 30 is denoted by reference sign L3; a width (a length in the left-right direction) thereof is denoted by reference sign W3; and a height (a length in the vertical direction) thereof is denoted by reference sign H3. Moreover, a length in the anteroposterior direction, a height (a length in the vertical direction), and a protruding length (a protruding length in the left-right direction) of the horizontal upper step portions 33*c*, 34*c* of the paired the extended engagement portions 33, 34 are denoted by reference signs L31, H31, and W31, respectively.

As described previously, in this embodiment, first of all, the plurality of contacts 20 in the first row are formed integrally with the first supporting member 35 made of the electrically-insulating synthetic resin material by insert molding in a way to that the cavity corresponding to the shape of the first common contact 30 is formed in the first supporting member 35 in advance. Next, the first common contact 30 is formed by injecting the conductive resin material from either or both of the paired extended engagement portions 33, 34. That is to say, the first common contact 30 is formed by two-step molding. The contact assembly C1 in the first row, in which the plurality of contacts 20 in the first row are integrally bonded together with the ground contacts 20*a* connected to the first common contact 30, is formed by this two-step molding method. At this time, the plurality of contacts 20 in the first row are arranged with every two adjacent signal line contacts 20*b*, 20*b* for transmitting high-speed signals interposed between two ground contacts 20*a*, or, the G-S-S-G pattern.

In this embodiment, dimensional relationships between the first supporting member 35 and the first common contact 30 areas follows because of the two-step molding method. Specifically, the relation L1>L3>L31 holds, because the first common contact 30 is formed inside the first supporting member 35. Meanwhile, W1=W3, W11=W31, and H11=H31, because the first engagement protrusions 36, 37 of the first supporting member 35, the horizontal upper step portions 33*c*, 34*c* of the extended engagement portions 33, 34 of the first common contact 30 are formed in a way to be fitted in the engagement groove 17.

Because the first common contact 30 are formed in this manner, to the first common contact 30 can electrically connect together all of the plurality of ground contacts 20*a* among the plurality of contacts 20 in the first row, and can resultantly equalize the electric potentials of each of the plurality of ground contacts 20*a*.

In this embodiment, because the first common contact 30 of this kind is included therein, it is possible to prevent reduction in a shielding effect attributable to ground conductive lines in two connector regions of the plug connector and the receptacle connector 10 in this embodiment. Accordingly, crosstalk between the signal lines is reduced, and noise emission is prevented.

Next, descriptions will be provided for the second common contact 50. The second common contact 50 is a member configured to electrically connect together the plurality of ground contacts (not shown), which are located in every third place among the plurality of contacts 40 in the second row, in block in order to equalize the electric potentials of the respective ground contacts. The second common contact 50 is formed by molding with the conductive resin injected into the cavity provided inside the second supporting member 55 after the plurality of contacts 40 in the second row are integrated together by the second supporting member 55.

To be specific, like the first common contact 30, the second common contact 50 is made of a conductive resin material, which is prepared by mixing micro particles or fibers of a conductive material such as carbon or nickel into a synthetic resin material such as an LCP or PPS. The second common contact 50 is integrally formed inside the second supporting member 55 by pouring this conductive resin material into the cavity formed in advance in the second supporting member 55, which is configured to integrally support the plurality of contacts 40 in the second row. The second common contact 50 is molded in a way to be in contact with the fixed portions 43 of the ground contacts (not shown), which are arranged in every third place among the plurality of contacts 40 in the second row like the contacts 20 in the first row.

Figure 8:
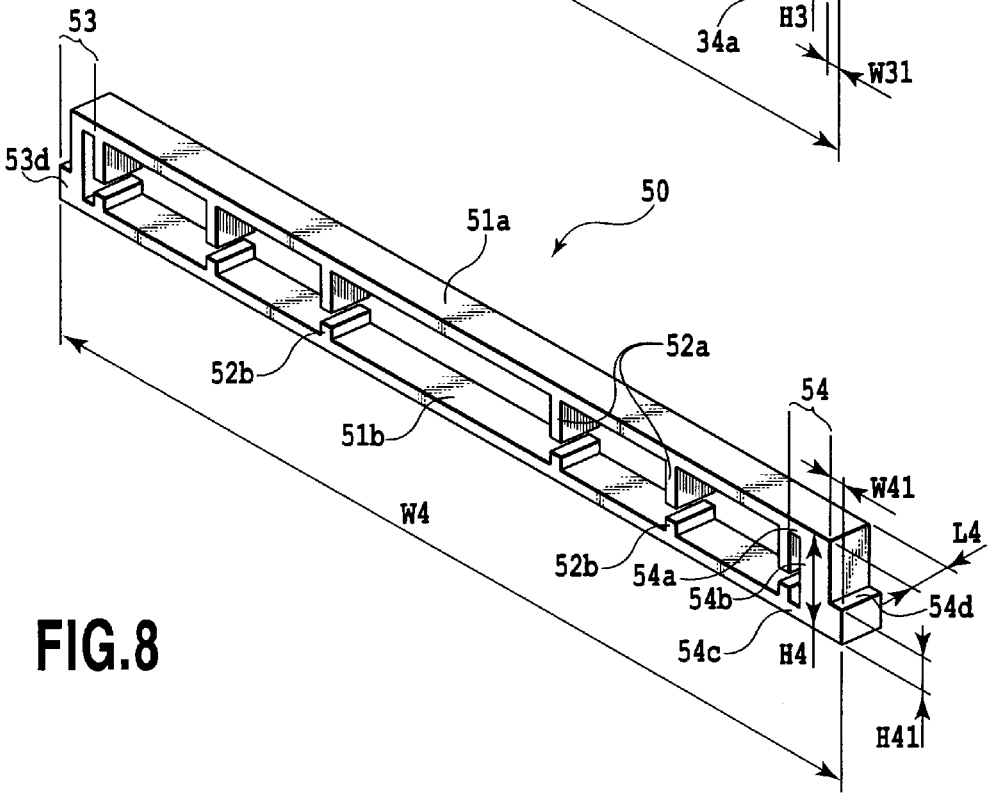
FIG. 8 is a perspective view of a second common contact which is one of the common contacts included in the receptacle connector shown in FIG. 1, and which is configured to connect the plurality of ground contacts in a second row.

FIG. 8 shows the second common contact 50 accordingly to this embodiment. The second common contact 50 includes an upper body 51*a* and a lower body 51*b* which are arranged in higher and lower positions, respectively; contact protrusions 52*a*, 52*b* respectively provided on the two bodies 51*a*, 51*b*; and a pair of extended engagement portions 53, 54 configured to connect the two bodies 51*a*, 51*b* together. The lower and upper elongated bodies 51*a*, 51*b* have the same length and the same width; extend in the left-right direction; are disposed parallel to each other; and are provided with the plurality of contact protrusions 52*a*, 52*b* configured to contact the corresponding fixed portions 43 of the ground contacts in the second row. The plurality of contact protrusions 52*a* provided on the upper body 51*a* protrude downward from the upper body 51*a*, extend in the anteroposterior direction, and are disposed parallel to one another. Similarly, the plurality of contact protrusions 52*b* provided on the lower body 51*b* protrude upward from the lower body 51*b*, extend in the anteroposterior direction, and are disposed parallel to one another. Note that the contact protrusions 52*a* provided on the elongated upper body 51*a* or the contact protrusions 52*b* provided on the elongated lower body 51*b* may be omitted.

The pair of extended engagement portions 53, 54 in this embodiment are provided in order that both ends of the upper body 51*a* are connected to both ends of the lower body 51*b*, respectively. Since the extended engagement portions 53, 54 make a pair, descriptions will be herein provided for only the extended engagement portion 54 configured to connect the right end sides of the respective upper and lower bodies 51*a*, 51*b* together, while omitting descriptions of the extended engagement portion 53 configured to connect the left end sides thereof together. In this embodiment, the extended engagement portion 54 configured to connect the right ends of the respective upper and lower bodies 51*a*, 51*b* includes a lower horizontal portion 54*c*, a vertical portion 54*b*, an upper horizontal portion 54*a*, and an engagement protrusion 54*d*; and is therefore shaped substantially like the letter h which is laid down, when viewed from the front. To be specific, the lower horizontal 54*c* protrudes horizontally rightward from a right end surface of the lower body 51*b* with a length which is equal to a length in the anteroposterior direction of the lower body 51*b*. Subsequently, the vertical portion 54*b* extends upward from a right end portion of the lower horizontal portion 54*c* at a right angle to the lower horizontal portion 54*c*. Further, the upper horizontal portion 54*a* extends horizontally leftward from an upper end of the vertical portion 54*b* at a right angle to the vertical portion 54*b*, and is connected to the upper body 51*a*. Furthermore, the engagement protrusion 54*d* is formed in a way to protrude in a rightward direction, which is opposite to a direction toward the lower horizontal portion 54*c*, from a lower end portion of the vertical portion 54*b*. As shown in FIG. 4, the engagement protrusion 54*d*, together with the second engagement protrusion 56 of the second supporting member 55, is fitted in the second engagement groove 19 provided in the inner surface of the right sidewall 11*d* of the housing 11, and is useful as a guide when the second supporting member 55 is installed into the second receiving space 18 of the housing 11.

Here, as shown in FIG. 8, a depth (a length in the anteroposterior direction) of the second common contact 50 is denoted by reference sign L4; a width (a length in the left-right direction) thereof is denoted by reference sign W4; and a height (a length in the vertical direction) thereof is denoted by reference sign H4. Moreover, a length in the anteroposterior direction, a height (a length in the vertical direction), and a protruding length (a protruding length in the left-right direction) of the engagement protrusions 53*c*, 54*d* of the paired extended engagement portions 53, 54 are denoted by reference signs L41, H41, and W41, respectively.

As described previously, in this embodiment, first of all, the plurality of contacts 40 in the second row are formed integrally with the second supporting member 55 made of the electrically-insulating synthetic resin material by insert molding in a way that the cavity corresponding to the shape of the second common contact 50 is formed in the second supporting member 55 in advance. Next, the second common contact 50 is formed by injecting the conductive resin material from either or both of the paired extended engagement portions 53, 54. The contact assembly C2 in the second row, in which the plurality of contacts 40 in the second row are integrally bonded together with the ground contacts connected to the second common contact 50, is formed by this two-step molding method. At this time, the plurality of contacts 40 in the second row are arranged with every two adjacent signal line contacts for transmitting high-speed signals interposed between two ground contacts, or in the G-S-S-G pattern.

In this embodiment, dimensional relationships between the second supporting member 55 and the second common contact 50 areas follows because of the two-step molding method. Specifically, L2>L4=L41 because the second common contact 50 is formed inside the second supporting member 55. Meanwhile, W2=W4, W21=W41, and H21=H41, because the engagement protrusions 56 of the second supporting member 55 and the engagement protrusions 53*d*, 54*d* of the extended engagement portions 53, 54 of the second common contact 50 are formed in a way to be fitted in the second engagement grooves 19.

Because the second common contact 50 are formed in this manner, the second common contact 50 can electrically connect together all of the plurality of ground contacts among the plurality of contacts 40 in the second row, and can resultantly equalize the electric potentials of each of the plurality of ground contacts. In addition, because the second common contact 50 of this kind is included therein, it is possible like the first common contact 30 to prevent reduction in a shielding effect attributable to the ground conductive lines in the two connector regions of the plug connector 80 and the receptacle connector 10 in this embodiment. Accordingly, crosstalk between the signal lines is reduced, and noise emission is prevented.

Figure 10:
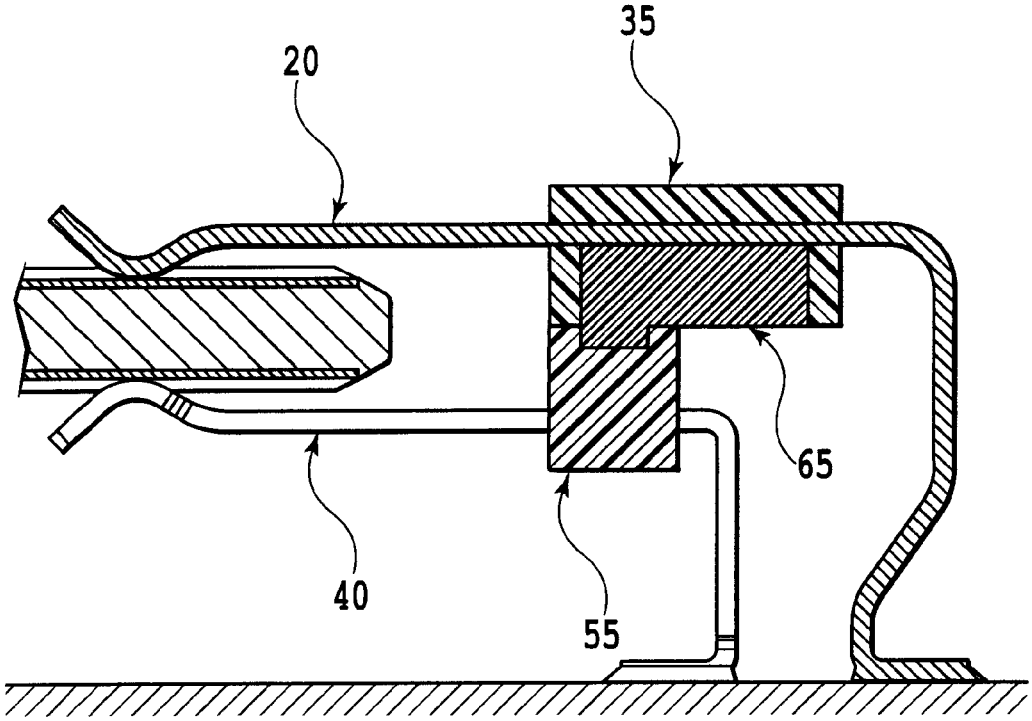
FIG. 10 is a cross-sectional view of principal part of an electrical connector which is a modification of the electrical connector shown in FIG. 1, which represents the electrical connector in a connected state.

In this embodiment, the contact assembly C1 in the first row and the contact assembly C2 in the second row are formed as separate assemblies. However, these assemblies may be formed into a single assembly instead. For example, the contact assembly C1 in the first row and the contact assembly C2 in the second row may be formed into a unified assembly by attaching the two contact assemblies together vertically by use of an adhesive or the like. Alternatively, as shown as a modified example of this embodiment in FIG. 10, the plurality of contacts 20 in the first row and the plurality of contacts 40 in the second row are integrally formed together with the first supporting member 35 and the second supporting member 55 by insert molding in a way that the cavity corresponding to the shape of a single common contact 65 is formed inside the first supporting member 35 and the second supporting member 55 in advance. Next, the common contact 65 is formed by injecting the conductive resin material into the cavity formed in advance in the first supporting member 35 and the second supporting member 55, thereby collectively forming the contact assembly C1 in the first row and the contact assembly C2 as the single assembly. Accordingly, the single common contact is configured to electrically connect together the plurality of ground contacts among the plurality of contacts 20 in the first row and the plurality of ground contacts among the plurality of contacts 40 in the second row. Incidentally, the single common contact 65 receives upward and downward forces produced which are produced by elastic deformation of the contacts 20 in the first row and the contacts 40 in the second row when the contacts 20 come into contact with the first pads 82*a* on the blade 81 and the contacts 40 come into contact with the second pads 82*b* on the blade 81. Hence, the contacts 20 and the contacts 40 can obtain the stable contact force. Furthermore, this enables simple and easy management of the dimensions concerning the heights (H1, H2) of the first engagement protrusions 36, 37 and the second engagement protrusions 56, and thereby makes it easier to assembly the receptacle connector 10.

Further, this embodiment uses the common contacts only for the receptacle connector 10. However, the present invention is not limited to this. The plug connector 80 may be provided with a common contact 85, a shown in FIG. 4. The common contact 85 electrically connects together all of the plurality of ground external contacts corresponding to the plurality of ground contacts 20*a* among the plurality of contacts 20 in the first row and the plurality of ground contacts among the plurality of contacts 40 in the second row. This configuration further enhances the operation and effect of crosstalk reduction produced by the providing of the first and second common contacts 30, 50 to the receptacle 10.

Next, brief descriptions will be provided how the contact assembly C1 in the first row and the contact assembly C2 in the second row are installed into the receptacle connector 10 according to this embodiment by using FIG. 2.

First of all, the second row contact assembly C2 is inserted from the back into the second receiving space 18 with the paired second engagement protrusions 56 of the second supporting member 55 fitted in the paired second engagement grooves 19 which are formed in the inner surfaces of the left and right sidewalls 11*c*, 11*d* of the housing 11. At this time, the contact portions 41 and the elastically-deformable portions 42 of the plurality of contacts 40 in the second row are placed inside the corresponding second slits 15. The contact assembly C2 in the second row is supported by and fixed to the receptacle connector 10, because the front surface and the lower surface of the second supporting member 55 abut on the back end surfaces 13*c* of the second partition walls 13 and the upper surface of the lower wall 11*b*.

Subsequently, the contact assembly C1 in the first row is inserted from the back into the second receiving space 18 with the paired first engagement protrusions 36, 37 of the first supporting member 35 fitted in the paired first engagement grooves 17 which are formed in the inner surfaces of the left and right sidewalls 11*c*, 11*d* of the housing 11. At this time, the contact portions 21 and the elastically-deformable portions 22 of the plurality of contacts 20 in the first row are placed inside the corresponding first slits 14. The contact assembly C1 in the first row is supported by and fixed to the receptacle connector 10, because the upper surface, the front surface and the lower surface of the first supporting member 35 abut on the lower surface of the upper wall 11*a*, the back end surfaces 12*c* of the first partition walls 12 and the upper surface of the second supporting member 55.

As a result, as shown in FIGS. 2 and 4, the contact assembly C1 in the first row and the contact assembly C2 in a second row are disposed parallel to each other inside the housing 11, whereby the assemblage of the receptacle connector 10 according to this embodiment is completed. Incidentally, as described previously, the further integration of the contact assembly C1 in the first row and the contact assembly C2 in the second row makes the assemblage easier and more secure, and makes it possible to reduce manufacturing (assembling) steps in number.

Figure 9:
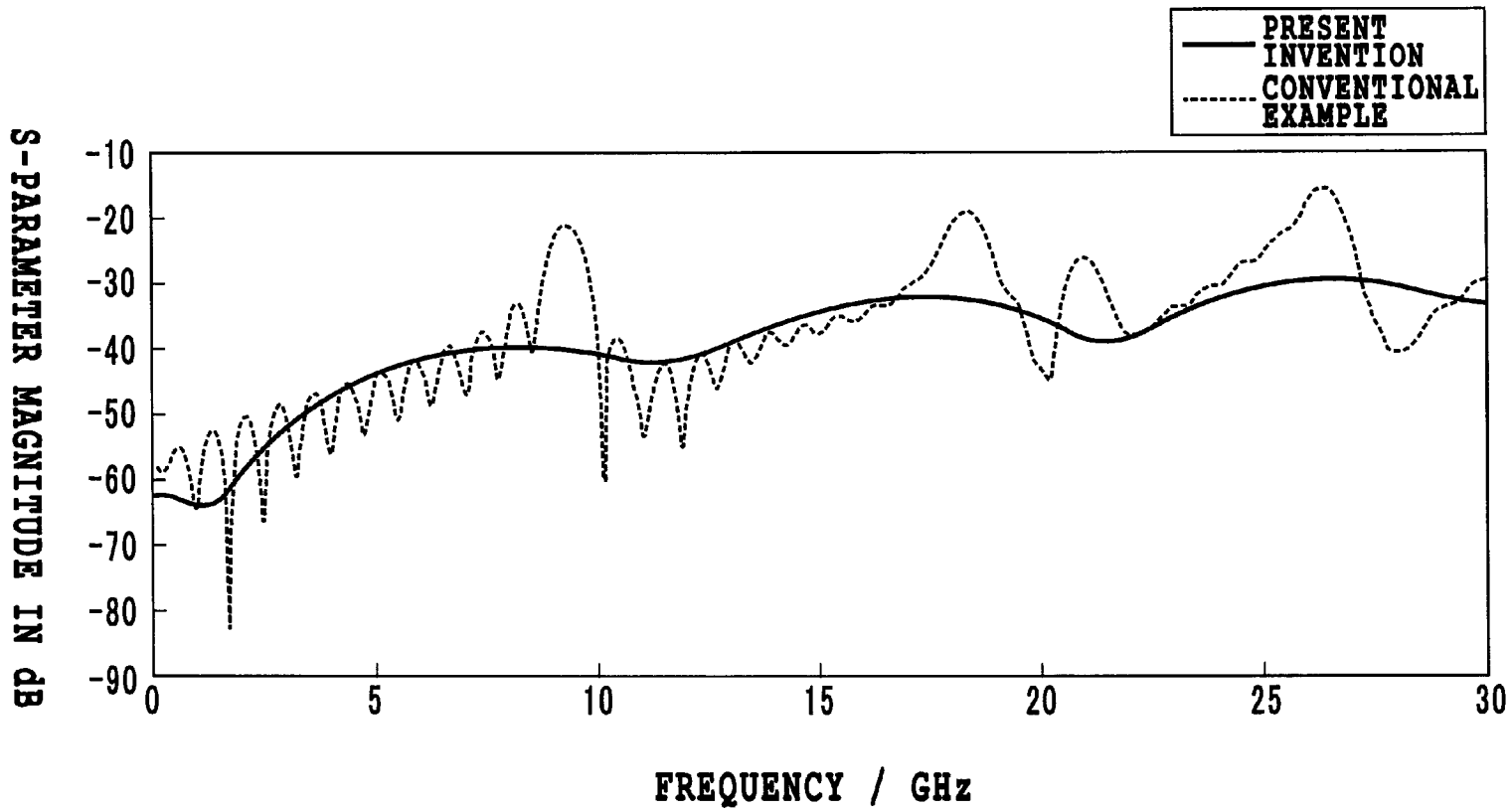
FIG. 9 is a graph in which cross talk reduction effects are compared between the common contacts made of a conductive resin according to the present invention and a conventional common contact made of conductive metal.

The receptacle connector 10 according to the present invention brings about excellent operation and effect of crosstalk reduction, because the plurality of contacts 20 in the first row and the plurality of contacts 40 in the second row are provided with the first common contact 30 and the second common contact 50, respectively. FIG. 9 shows a graph comparing the present invention and a conventional example in terms of crosstalk reduction. In FIG. 9, a solid line indicates the amount of crosstalk which occurs when signals are transmitted at high speed through the receptacle connector 10 including the first and second common contacts 30, 50 which are made of the conductive resin material according to the present invention. A dotted line therein indicates the amount of crosstalk which occurs when signals are similarly transmitted at high speed through a receptacle connector including the first and second common contacts which are made of a conventional conductive metal material. As shown in FIG. 9, in the case the common contacts are made of the conventional metal material, ripples occur when the frequency of signals to be transmitted at high speed reaches about 9, 18, 21, and 27 GHz and their vicinities, and insertion loss peaks around these frequencies. From this, it is apparent that the amount of crosstalk accordingly reaches peaks of over −30 dB around these frequencies as well. Considering that it is desirable to reduce the amount of crosstalk to −40 dB or less, it is understood that the conventional receptacle connector is unsatisfactory when the frequency is higher. On the other hand, it is clear that, in the case where the common contacts are made of the conductive resin material whose electric conductivity is far smaller than the electric conductivity of the metal material as in the present invention, the amount of crosstalk gently increases until the frequency reaches 30 GHz, and even the largest amount of crosstalk is reduced to −30 dB or less.

The including of the above-described configuration in the receptacle connector of the present invention makes the structure of the receptacle connector simpler and the production of the receptacle connector easier, and makes it possible to reduce the amount of crosstalk sufficiently.

The embodiment has been described on the basis of the concept that the common connectors are provided only to the contacts 20, 40 of the receptacle connector 10. However, the present invention is not limited to this configuration. As described previously, the common contacts may be provided to the plug connector included in the electrical connector as well. Thereby, it is possible to prevent reduction in the shielding effect attributable to the ground conductive lines in the two connector regions of the plug connector and the receptacle connector, and also to reduce the amount of crosstalk at the same time.

While the present invention has been described with reference to exemplary embodiments, it is to be understood that the invention is not limited to the disclosed exemplary embodiments. The scope of the following claims is to be accorded with the broadest interpretation so as to encompass all such modifications and equivalent structures and functions.

What is claimed is:

1. A receptacle connector used for an electrical connector configured to connect two circuit boards to each other, comprising:

a housing made of an electrically-insulating synthetic resin material, and including an upper wall, a lower wall, and left and right sidewalls, the housing having a receiving space formed therein, the receiving space having an opening portion, through which a connection target is inserted, on a front side thereof;

a plurality of contacts made of a metal material and arranged parallel to one another, the plurality of contacts including a plurality of signal line contacts and a plurality of ground contacts, and being placed with every two adjacent signal line contacts interposed between two ground contacts;

a supporting member made of an electrically-insulating synthetic resin material, and configured to integrally support and fix thereto the plurality of contacts; and a common contact made of a conductive resin material and configured to electrically connect the plurality of ground contacts together among the plurality of contacts;

wherein the plurality of contacts are received in the receiving space of the housing, the plurality of contacts being integrated together by the supporting member, and all the plurality of ground contacts among the plurality of contacts being electrically connected together by the common contact.

2. The receptacle connector according to claim 1, wherein the plurality of contacts are formed into two contact assemblies each integrated together by the supporting member, the two contact assemblies are disposed parallel to each other inside the receiving space of the housing, and the two circuit boards are electrically connected to each other by inserting the connection target between the two contact assemblies disposed parallel to each other.

3. The receptacle connector according to claim 2, wherein the two contact assemblies are further integrated together.

4. The receptacle connector according to claim 1, wherein the plurality of contacts are integrally supported by and fixed to the supporting member with insert molding.

5. The receptacle connector according to claim 4, wherein:

the common contact is configured to electrically connect together the plurality of ground contacts in the two contact assemblies.

6. An electrical connector configured to connect two circuit boards to each other, comprising:

the receptacle connector according to claim 1 being attached to one of the two circuit boards; and a plug connector attached to the other circuit board and configured to be inserted to the receptacle connector, wherein the plug connector includes:

a blade;

a plurality of external contacts arranged corresponding to the plurality of contacts of the receptacle connector; and the common contact is configured to electrically connect a plurality of ground external contacts together among the plurality of external contacts, the plurality of ground external contacts corresponding to the plurality of ground contacts of the receptacle connector.

* * * * *